US006050194A

United States Patent [19]

Bugiel et al.

[11] Patent Number: 6,050,194

[45] Date of Patent: Apr. 18, 2000

[54] SENSOR ARRANGEMENT FOR TARGET-SEEKING AMMUNITION

[75] Inventors: Horst-Georg Bugiel, Bonn-Ippendorf; Jurgen Schloss, Oberasbach, both of Germany

[73] Assignee: Diehl Stiftung & Co., Nümberg, Germany

[21] Appl. No.: 06/700,944

[22] Filed: Dec. 10, 1984

[30] Foreign Application Priority Data

Dec. 16, 1983 [DE] Germany ..... 33 45 529

[51] Int. Cl.[7] ..... F42C 13/00; F42C 13/02; F42C 13/04; F42B 12/10

[52] U.S. Cl. ..... 102/211; 102/213; 102/214; 102/476

[58] Field of Search ..... 102/211, 213, 102/214, 476, 384; 244/3.16, 3.19

[56] References Cited

U.S. PATENT DOCUMENTS 3,935,818 2/1976 Johnson et al. ..... 102/213

FOREIGN PATENT DOCUMENTS 1090957 4/1955 France .
1285932 1/1962 France .
1293794 4/1962 France ..... 102/476
2382672 9/1978 France .
1444029 6/1986 France .
2353566 5/1974 Germany .

OTHER PUBLICATIONS

German Search Report.

Journal Wehrtechnik, Kampfwertsteigerung bei Artillerie-emunition Jan. 1983. p. 73.

*Primary Examiner*—Charles T. Jordan

*Attorney, Agent, or Firm*—Scully, Scott, Murphy & Presser

[57] ABSTRACT

A sensor arrangement for target-seeking ammunition which includes an insert for forming a hollow charge, and in front of which there is positioned a transducer for electromagnetic radiation energy. The sensor arrangement of the above-constructional type has the transducer located in the longitudinal axis of symmetry of the ammunition and of the insert. The insert forming the combat charge may itself serve as a focusing reflector for the operating characteristics of the sensor arrangement. Inasmuch as there is available for the aperture practically the entire caliber of the ammunition; in effect, the front surface of the insert facing into the effective direction, there can be obtained an extremely favorable operating characteristic for the sensor arrangement.

10 Claims, 2 Drawing Sheets

SENSOR ARRANGEMENT FOR TARGET-SEEKING AMMUNITION

BACKGROUND OF THE INVENTION

1. Field of the Invention

The present invention relates to a sensor arrangement for target-seeking ammunition which includes an insert for forming a hollow charge, and in front of which there is positioned a transducer for electromagnetic radiation energy.

2. Discussion of the Prior Art

Ammunition is equipped with such sensor arrangements in which the detonation is triggered at a certain distance from the target, when electronic ignition sensors receive electromagnetic radiation energy from the target or from the target surroundings which is specific to the target. Moreover, such sensor arrangements serve in the so-called intelligent ammunition for the purpose of target searches and for the delivery of information for target tracking or, respectively, for target discrimination, in the interest of obtaining a highly effective degree of utilization of the ammunition. The ammunition can relate to ballistically fireable projectiles, and/or projectiles or missiles which are equipped with self-contained propulsion devices, and especially with regard to subordinate ammunition which is transported over a target area by a carrier and there expelled. For this last-mentioned case of application, a sensor arrangement of the above constructed type is known from the disclosure of German Laid-Open Patent Application 23 53 566, also known as the SADARM-principle from the journal WEHRTECHNIK, Volume 1, 1983, page 73.

SUMMARY OF THE INVENTION

Accordingly, it is an object of the present invention to so improve upon a sensor arrangement of the above-constructional type in order that the conflicting types of requirements, on the one hand, for a large aperture in the interest of good aiming characteristics and focusing, and on the other hand, the small necessary installation spaces, can be fulfilled in harmony with each other under the lowest possible detrimental influences over the technological requirements of the ammunition.

The foregoing object is inventively achieved in that the sensor arrangement of the above-constructional type has the transducer located in the longitudinal axis of symmetry of the ammunition and of the insert.

Pursuant to the foregoing object, the insert forming the combat charge, itself serves as a focusing reflector for the operating characteristics of the sensor arrangement. Inasmuch as there is available for the aperture practically the entire caliber of the ammunition; in effect, the front surface of the insert facing into the effective direction, there can be obtained an extremely favorable operating characteristic for the sensor arrangement. Hereby, the front surface of the insert can itself serve as a reflector; or, however, it can serve as a support for a light-weight compensating member which, in turn, produces a three-dimensional reflector curvature which is optimized with regard to the radiation geometry. Thus, the actual sensor-transducer is located centrally in front of the insert, which provides the symmetry and the coaxial focusing of the operating characteristics with respect to the directional effect of the ammunition in a desirable manner. An especially short axial construction is obtained for the sensor arrangement when the transducer is located between the insert and a subordinate reflector, so as to allow for the formation of the advantageous Cassegrain radiation geometry. The power supply to the transducer can be implemented coaxially with the axis of the ammunition through the center of the insert along the shortest path, or effected radially offset by means of a sweep or arc in front of the insert. The high-frequency component for the operation of the transducer is suitably arranged within the active charge, which provides for a relatively short connecting path to the transducer and, in particular, a configuring of the high-frequency component for the deflection of the detonation waves in the detonated combat charge; in effect, a wave propagation for the deformation of the insert into the projectile which is to be fired.

BRIEF DESCRIPTION OF THE DRAWINGS

Additional alternatives and modifications, as well as further features and advantages of the invention can be ascertained from the following detailed description of two exemplary embodiments which are extensively restricted in the drawings to the essential features, but are generally correct in scale; taken in conjunction with the accompanying drawings; in which.

DETAILED DESCRIPTION

Figure 1:
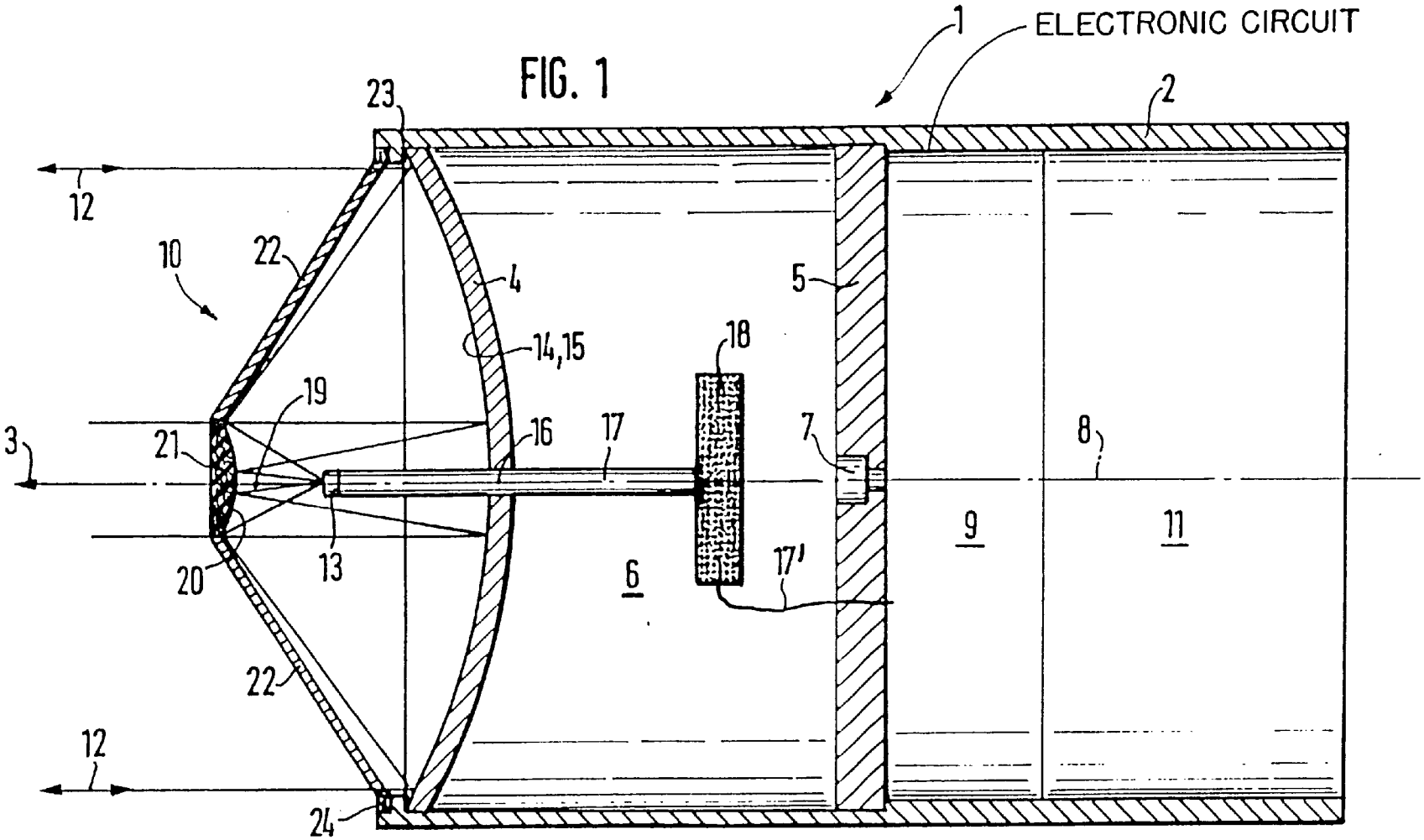
FIG. 1 illustrates a longitudinal sectional view through a sensor arrangement for target-seeking ammunition.

The ammunition 1 which is illustrated in FIG. 1 in a longitudinal sectional view, and which is especially employable as subordinate or secondary ammunition, essentially consists of a hollow cylinder 2 which is closed off in the direction of effect 3 by means of a hollow charge-insert 4 constituted of a plastically deformable metal. Enclosed between the insert 4 and a rear damming wall 5, is the explosive of the combat charge 6. Its detonator 7 is arranged in the wall 5 along the longitudinal axis 8 of the hollow cylinder 2, which coincides with the direction of effect 3. The detonator is activated through an electronic circuit 9 which is arranged rearwardly of the wall 5, when the sensor arrangement 10 detects, in the direction of effect 3, a target object which is to be attacked within the target area (not shown in the drawing). For effecting the braked-down dropping into the target area, the ammunition 1 is equipped with a parachute, which, prior to its ejection triggered by the circuit, is folded into a storage space 11 in the rear of the ammunition 1.

Basically, the frequency range of electromagnetic radiation energy which is received by the sensor arrangement 10 from the target area is random in nature. In the interest of obtaining a high resolution capability, notwithstanding the limited installation space available for the aperture, for the target search in order to trigger the detonation, such as subsequent to target discrimination, there is preferably operated with electromagnetic radiation energy within the infared or the millimeter wave spectral range. The sensor arrangement 10 can operate actively; in effect, as a reflected beam direction-finding installation for the irradiation and return-receipt of energy reflected from the target area; or it can operate passively, in effect, only evaluating the energy irradiated from the target area. In the interest of obtaining a high resolution capability, the sensor arrangement 10 possesses an operating characteristic 12 which is focused into beam parallelity, for the purpose of which a concave reflector 14 has a transducer 13 arranged in front thereof. This reflector 14 extends then directly in front of the hollow charge insert 4 over essentially the entire front surface thereof and, in the embodiment pursuant to FIG. 1, is itself formed by the three-dimensional, parabolically curved front surface 15 of the insert 4 which, in turn, for the forming of the projectile upon the detonation of the combat charge 6, possesses an essentially obtusely-angled cross-section, with tangents oriented transversely of the longitudinal axis in its center 16.

In the embodiment pursuant to FIG. 1, the sensor arrangement 10 incorporates a transducer 13, in the case of an active sensor arrangement 10 a radiation emitter, whose electrical connection 17 (for example, a hollow cable in the case of a millimeter-wave radiation emitter) extends rearwardly along the system axis 8 through the insert and reflector center 16 into the interior of the hollow cylinder 2 towards a high-frequency component 18 designed as a transmitter and/or as a receiver.

Through its spherical directional characteristic 19, the transducer 13 detects the convex reflector surface 20 of a subsidiary or secondary reflector 21 located in front thereof, which is oriented opposite to the main reflector 14. This arrangement of the reflectors 14 and 21, with the inbetween located small-surfaced transducer 13, thereby corresponds to a Cassegrain radiation deflector for achieving a good focusing which a large surface-acting aperture notwithstanding the small cross-section, and thereby the spherical directional characteristic 19 of the transducer 13. Contrastingly, the subsidiary reflector surface 20 is constructed hyperbolically, when the effective surface of the main reflector 14 is parabolic; however, when due to reasons caused by the technology of the ammunition, there are encountered deviations in the curvature of the surface 15 of the insert 4 from the pure parabolic configuration of the main reflector 14, then in the interest of the parallel orientation of the operating characteristic 12, in a known manner these can be compensated through suitable geometric deformations of the subsidiary reflector surface 20.

Preferably, the high-frequency component 18 is not located behind the damming wall 5, but rather in and/or in front thereof, and thereby against or within the space in the hollow cylinder 2 which is assumed by the combat charge 6. As illustrated in FIG. 1, the configuration and arrangement of the high-frequency component 18 is essentially disc-shaped, and oriented at a certain distance in front of the wall 5, in parallel therewith. Thereby, it is possible to employ the mass of the high-frequency component 18 for the timely and spatially optimized dissipation of the gases from the explosive which are generated during the detonation of the combat charge 6 in front of the detonator 7, in effect, in the center of the damming wall 5, and due to the axially spreading along the axis 8 would not contribute the desirable deformation kinetics of the insert 4 which is to be fired. The effect of this high-frequency component 18 which is arranged for deflection in front of the center of the wall 5 is, in contrast, a deflection of the pressure distribution towards the wall of the hollow cylinder 2 and along therewith in the direction of effect 3, from where there is effected a superposition of the forces for the desirable deformation of the insert 4 into the projectile which is to be fired into the detected target. This allows for the use of an axially flat-constructed combat charge 6 with, in the interest of the reflector function, an exceptionally shallow-curved insert 4, and yet still the deformation thereof into a high intensity fired projectile. These possibilities in the formation of a flat warhead is also facilitated by the additional measures which are also illustrated in connection therewith in FIG. 2, pursuant to which the high-frequency component 18 possesses the shape, in the cross-section of a forwardly opening plate-shaped disc. The therewith obtained control over the gas pressure distribution extending from the axis 8 towards the periphery of the inner wall of the hollow cylinder 2, is additionally enhanced by at least one inclined annular passageway 27 along the outside of the plate whereby, in the corner between the hollow cylinder 2 and the damming wall 5, there is arranged a shielding and conductor ring 28 with a frusto-conically shaped inner wall widening in the direction of effect, which can be constructed hollow in order to receive, for example, a further circuit component 9'. The ring acts in opposition to a premature reduction of the explosive gas pressure due to the enclosing corner of the wall 5 which, just at the small axial distance between the damming wall 5 and the initially only shallow-curved, insert 4 is critical in its construction because of an excessive dynamic loading, since it can trigger a rarefaction wave which can prematurely initiate the desired pressure distribution across the insert 4.

The subsidiary reflector 21 is held through the intermediary of support ribs 22 in front of the main reflector 14, which are fastened in the region of the axial clamping location 23 to the end surface of the hollow cylinder 2. Inasmuch as the subsidiary reflector 21 is constituted of a light-weight material, such as plastic, (with a sealing against environmental effects such as deposition of condensate liquids) with a metal-coated surface facing the reflector surface 20, and due to the comparatively large distance of the subsidiary reflector 21 in front of the center 16 of the insert 4, there is no need to fear any significant undue influence over the behavior during the forming and firing of the projectile which is formed from the insert 4, due to the subsidiary reflector 21 which is located in the effective axes 3,8. However, there can also be additionally provided to arrange, in the region of the fastening of the support ribs 22, in clamping for the insert 23 (or with the subsidiary reflector 21, but not considered in the drawing) small pyrotechnically active charges 24, which are activated with or prior to the combat charge detonator 7, in order to timely, prior to the firing of the projectile which was formed from the insert 4, to remove the subsidiary reflector 21 from the direction of effectiveness 3 of the projectile.

Figure 2:
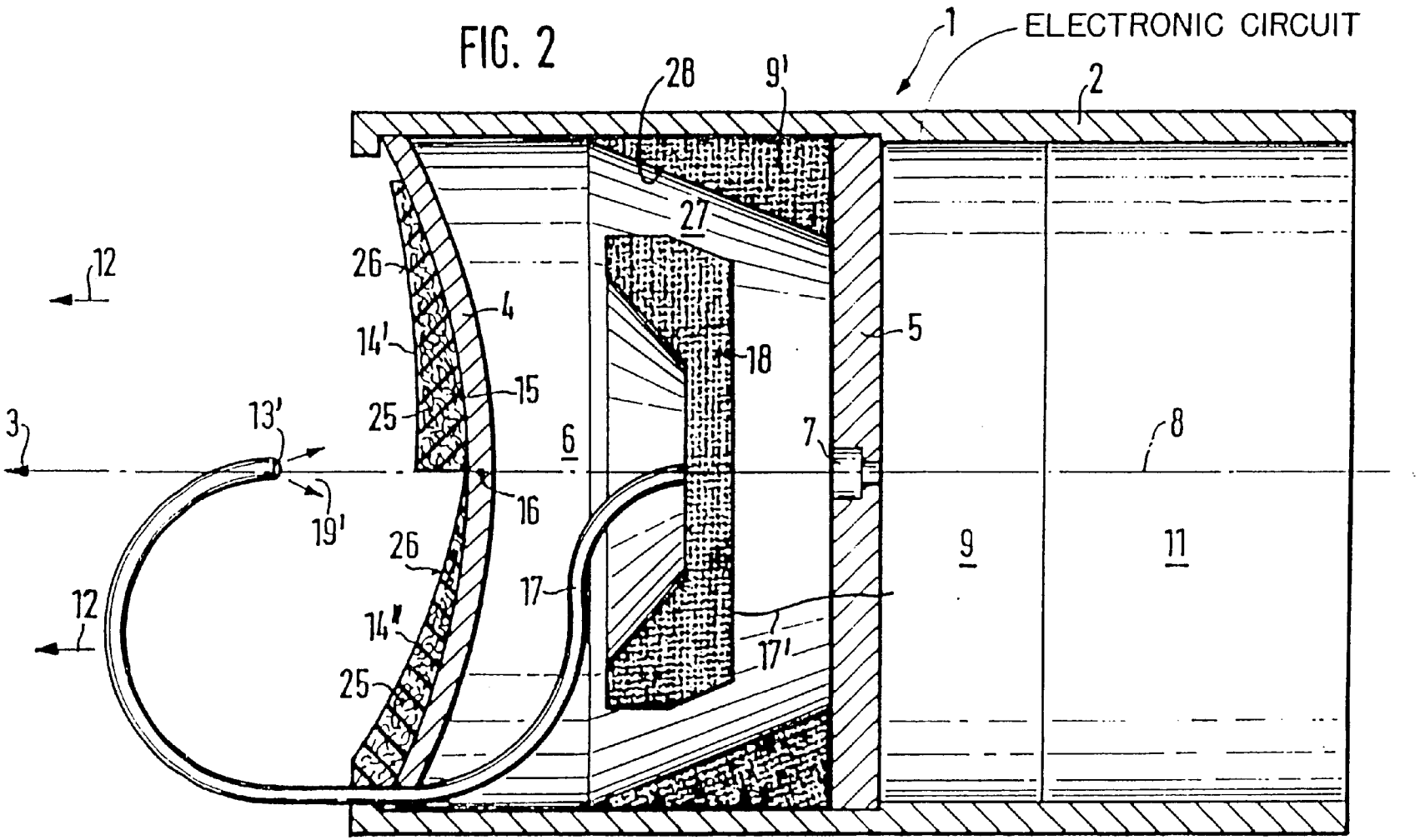
FIG. 2 illustrates a sensor arrangement modified with respect to that in FIG. 1, in connection with the constructive conditions of the support and the electrical connection of the transducer.

In the modified embodiment pursuant to FIG. 2, further consideration is given to that the required or in any event desirable concave curvature of the insert 4 in the direction of effectiveness 3 due to technical ammunition conditions, will under circumstances deviate to such an extent from the geometric requisites for the (main) reflector 14 for the formation of the required operating characteristic 12, that notwithstanding the described measures, in the high-frequency component 18, the shallow-concavely curved front surface 15 of the insert cannot yet be directly introduced as the reflector 14. In this case, there can be provided, that in front of the insert 4 there is located a, for example, vulcanized on compensating member 25 of a lesser specific density (for example, a foamed material, which is sealed with respect to environmental influences), which will practically not hinder the deformation of the insert 4 into a projectile, but which can have and in its front surface 26 optionally correlated with the requirements of the radiation geometry. The front surface 26 which is mirrored towards the reflector 14 through vapor-deposition coating, can also possess a still slighter (14'), but also a more extensive (14") curvature, than the front curvature of the insert 4.

In the embodiment pursuant to FIG. 2 which is modified relative to that of FIG. 1, in contradistinction with the Cassegrain arrangement according to FIG. 1, there is provided a direct radiation connection between the transducer 13 and the reflector 14', 14" in which the directional characteristic 19' of the transducer in the direction of effectiveness of the ammunition 3 oppositely is directly oriented towards the reflector 14', 14". The electrical connection 17 of the transducer 13' to the high-frequency frequency component 18 which is located interiorly of the hollow cylinder 2; in effect, behind the insert 4, contrary to the conditions of FIG. 1, now extends no longer along the axis 8 through the insert center 16, but axially-parallel and radially offset through the rim region of the insert 4 and in front thereof in an arc towards to the transducer 13' which is located in the longitudinal axis 8. Avoided thereby are any disturbances in deformation in the center 16 of the insert 4.

What is claimed is:

1. In a target-seeking ammunition having a combat charge; a projectile-forming insert configured as a reflector arranged in front of said combat charge; and a sensor transducer located in front of said insert along the axis of symmetry thereof; the improvement comprising: a damming wall rearwardly of said insert; a sensor high-frequency component in said combat charge behind said insert and centrally in front of said damming wall for deflecting a pressure distribution of explosive gases; and an electrical connection extending through said insert for connecting said high-frequency component with said transducer.

2. Ammunition as claimed in claim 1, wherein an annular gas-flow passageway expanding in a direction towards said insert encompasses said sensor high-frequency component.

3. Ammunition as claimed in claim 1, wherein said sensor high-frequency component possesses a disc-shaped geometry.

4. Ammunition as claimed in claim 1, wherein a conductive ring having a frusto-conically widening configuration towards said insert is arranged intermediate said high-frequency component and said damming wall.

5. Ammunition as claimed in claim 1, wherein said sensor high-frequency component comprises a dished plate opening in a direction towards said insert.

6. Ammunition as claimed in claim 1, wherein an electrical connection extends coaxially through the center of said insert between said high-frequency component and said sensor transducer.

7. Ammunition as claimed in claim 1, wherein an electrical connection extends through the edge of said insert axially-parallel offset relative to the longitudinal axis of the ammunition between said high-frequency component and said sensor transducer.

8. Ammunition as claimed in claim 1, wherein said high-frequency component comprises a detonation wave guide for compensating ammunition-generated disturbances emanating from a secondary reflector arranged in front of said transducer.

9. Ammunition as claimed in claim 8, wherein support ribs fasten said secondary reflector to said ammunition; and said ammunition includes explosive charges for expelling said support ribs.

10. Ammunition as claimed in claim 8, wherein said reflector and secondary reflector are constituted of shaped members of lightweight material including a metallically-coated reflective surface.

* * * * *